US007213340B1

(12) United States Patent
Lee

(10) Patent No.: US 7,213,340 B1
(45) Date of Patent: May 8, 2007

(54) BATTERY-OPERATED CAN OPENER

(76) Inventor: Hui-Ling Lee, No. 258-5, Fentsao Rd., Tsaotun Town, Nantou County (TW)

( * ) Notice: Subject to any disclaimer, the term of this patent is extended or adjusted under 35 U.S.C. 154(b) by 0 days.

(21) Appl. No.: 11/250,432

(22) Filed: Oct. 17, 2005

(51) Int. Cl.
*B67B 7/46* (2006.01)

(52) U.S. Cl. ..... 30/416; 30/434

(58) Field of Classification Search ..... 30/2, 30/400, 409, 417, 416, 423–427, 429, 430, 30/433, 434; D8/36, 39, 41
See application file for complete search history.

(56) References Cited

U.S. PATENT DOCUMENTS

| | | | | | |
|---|---|---|---|---|---|
| 2,713,198 | A * | 7/1955 | Sapp | 30/444 |
| 3,528,175 | A * | 9/1970 | Rich | 30/403 |
| 4,622,749 | A * | 11/1986 | Inagaki | 30/421 |
| 4,702,007 | A * | 10/1987 | Nomura et al. | 30/423 |
| 4,734,985 | A * | 4/1988 | Ozaki | 30/404 |
| 4,995,164 | A * | 2/1991 | Borger et al. | 30/423 |
| 5,228,203 | A * | 7/1993 | Hahn | 30/418 |
| 5,239,757 | A * | 8/1993 | Weaber | 30/401 |
| 5,664,333 | A * | 9/1997 | Hardman | 30/423 |
| 6,510,613 | B1 * | 1/2003 | Wall | 30/410 |
| 6,516,524 | B1 * | 2/2003 | Brady | 30/404 |
| 6,886,260 | B1 * | 5/2005 | Lee | 30/421 |
| 2002/0148122 | A1 * | 10/2002 | Sanchez et al. | 30/421 |
| 2005/0229397 | A1 * | 10/2005 | Neiser et al. | 30/2 |
| 2005/0235501 | A1 * | 10/2005 | So | 30/425 |
| 2006/0248725 | A1 * | 11/2006 | Huang et al. | 30/2 |

* cited by examiner

*Primary Examiner*—Jason Prone
(74) *Attorney, Agent, or Firm*—Rosenberg, Klein & Lee

(57) ABSTRACT

A battery-operated can opener includes a DC motor, a battery, a switching lever that controls electric connection between the battery and the DC motor, an actuating arm coupled to the switching lever for moving a cutter out of the can opening for cutting the lid of a can when switching on the DC motor, a guide gear wheel coupled to the DC motor through a transmission gear set for moving the can opener along the rim of the can to force the cutter to cut open the lid of the can.

2 Claims, 4 Drawing Sheets

BATTERY-OPERATED CAN OPENER

BACKGROUND OF THE INVENTION

1. Field of the Invention

The present invention relates to a can opener and more particularly, to a battery-operated can opener.

2. Description of the Related Art

A conventional can opener is a hand tool having a handle and a cutter at one side of the handle. When opening a can, the user must bias the can opener and move the can opener along the rim of the can. It is inconvenient to use a conventional can opener to open a can. Further, using a conventional can opener to open a can requires much effort. When biasing a can opener to open a can, the can opener may slip from the rim of the can.

SUMMARY OF THE INVENTION

The present invention has been accomplished under the circumstances in view. According to one aspect of the present invention, the battery-operated can opener comprises a DC motor, a battery, a switching lever that controls electric connection between the battery and the DC motor, an actuating arm coupled to the switching lever for moving a cutter out of the can opening for cutting the lid of a can when switched on the DC motor, a guide gear wheel coupled to the DC motor through a transmission gear set for moving the can opener along the rim of the can to force the cutter to cut open the lid of the can. According to another aspect of the present invention, a return spring is connected between the bottom cover shell of the can opener and the actuating arm to automatically return the switching lever and the actuating arm when the user releases the switching lever after the cutting operation.

DETAILED DESCRIPTION OF THE INVENTION

Figure 1:
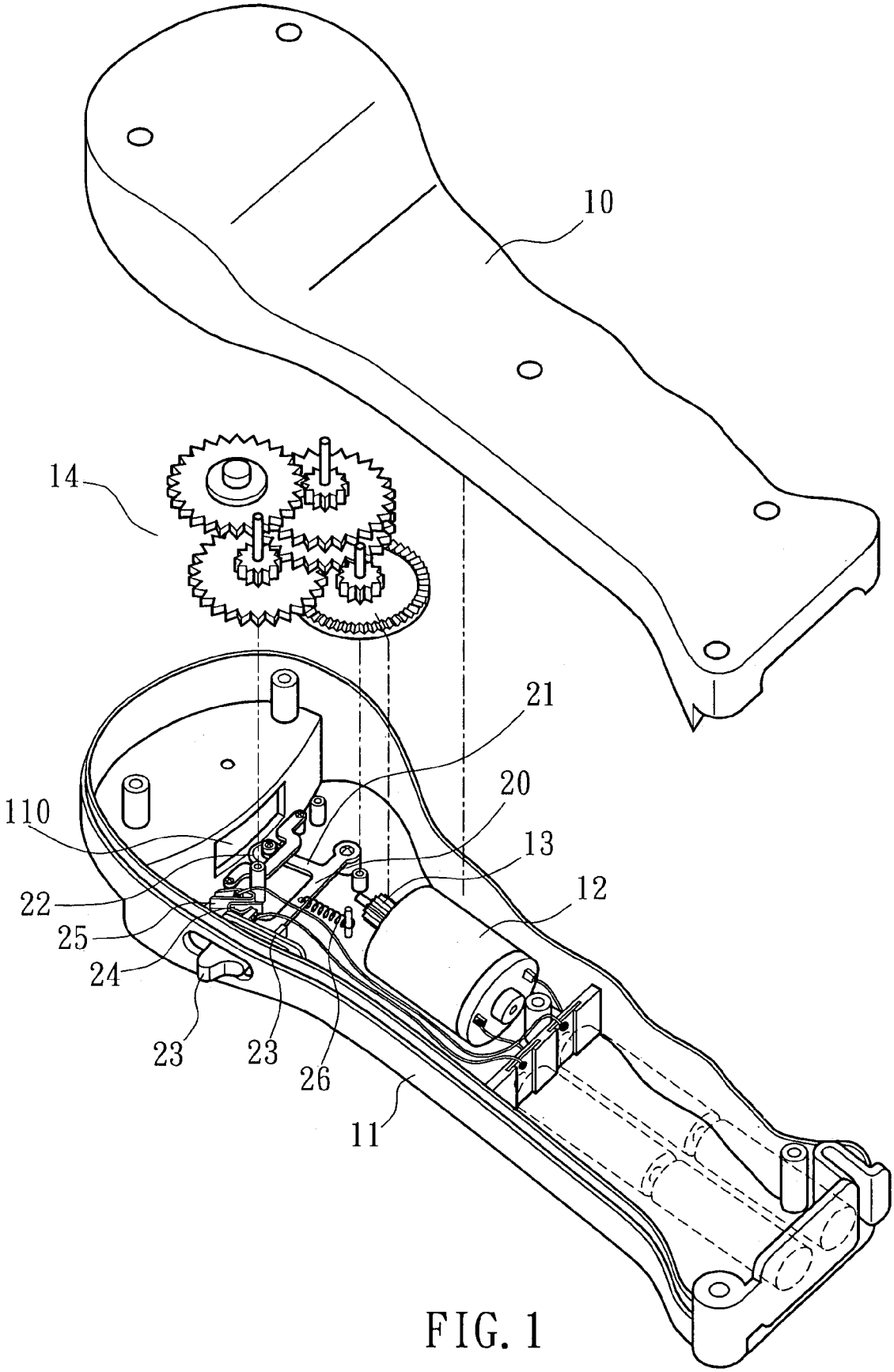
FIG. 1 is an exploded view of a battery-operated can opener according to the prior art.
Figure 2:
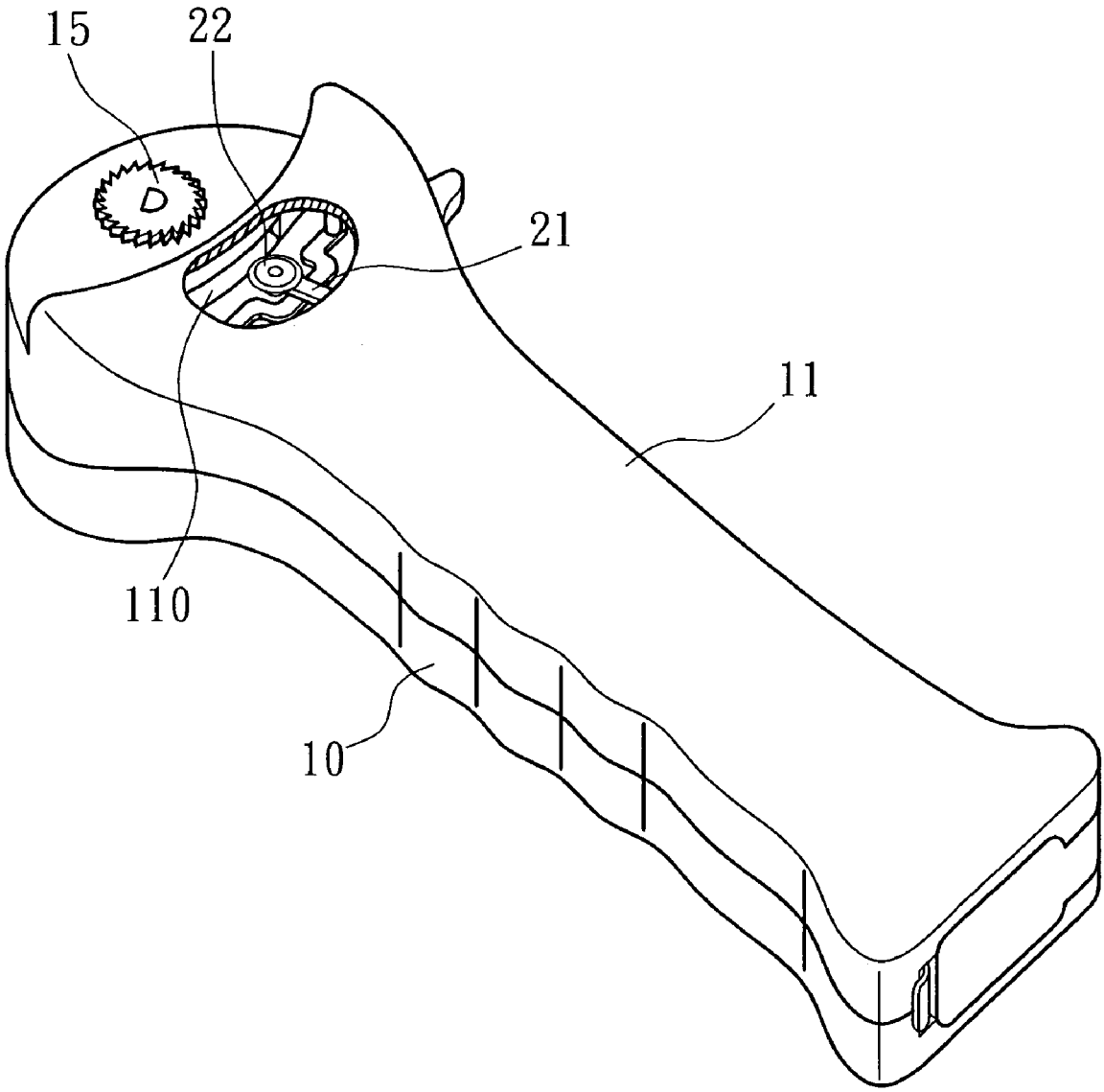
FIG. 2 is an elevational assembly view of the battery-operated can opener according to the present invention.

Referring to FIGS. 1 and 2, a battery-operated can opener in accordance with the present invention is shown comprising a bottom cover shell 11, a top cover shell 10 covering the bottom cover shell 11, a DC motor 12 mounted in the bottom cover shell 11, a pinion 13 fixedly mounted on the output shaft of the DC motor 12, a transmission gear set 14 mounted inside the bottom cover shell 11 and coupled to the pinion 13, a switching lever 23 pivotally mounted in one side of the bottom cover shell 11 and partially extending out of the bottom cover shell 11 for operation by hand, a first metal contact 25 fixedly mounted inside the bottom cover shell 11 and electrically connected to one pole of the battery inside the bottom cover shell 11 and one pole of the DC motor 12, a second metal contact plate 24 fixedly mounted on one end of the switching lever 23 and electrically connected to the other pole of the battery inside the bottom cover shell 11 and the other pole of the DC motor 12 and movable with the switching lever 23 to contact the first metal contact 25 and to further close the circuit of the battery and the DC motor 12, an actuating arm 20, which has one end pivotally secured to the bottom cover shell 11 and the other end connected to the switching lever 23, a return spring 26 connected between the bottom cover shell 11 and the actuating arm 20, an extension rod 21 perpendicularly extending from the actuating arm 20, a cutter 22 fixedly connected to the extension rod 21 and movable with the extension rod 21 in and out of an opening 110 in the bottom cover shell 11, and a guide gear wheel 15 pivotally mounted on the outside of the bottom cover shell 11 near the opening 110 and coupled to the transmission gear set 14 for rotation by the transmission gear set 14.

Figure 3:
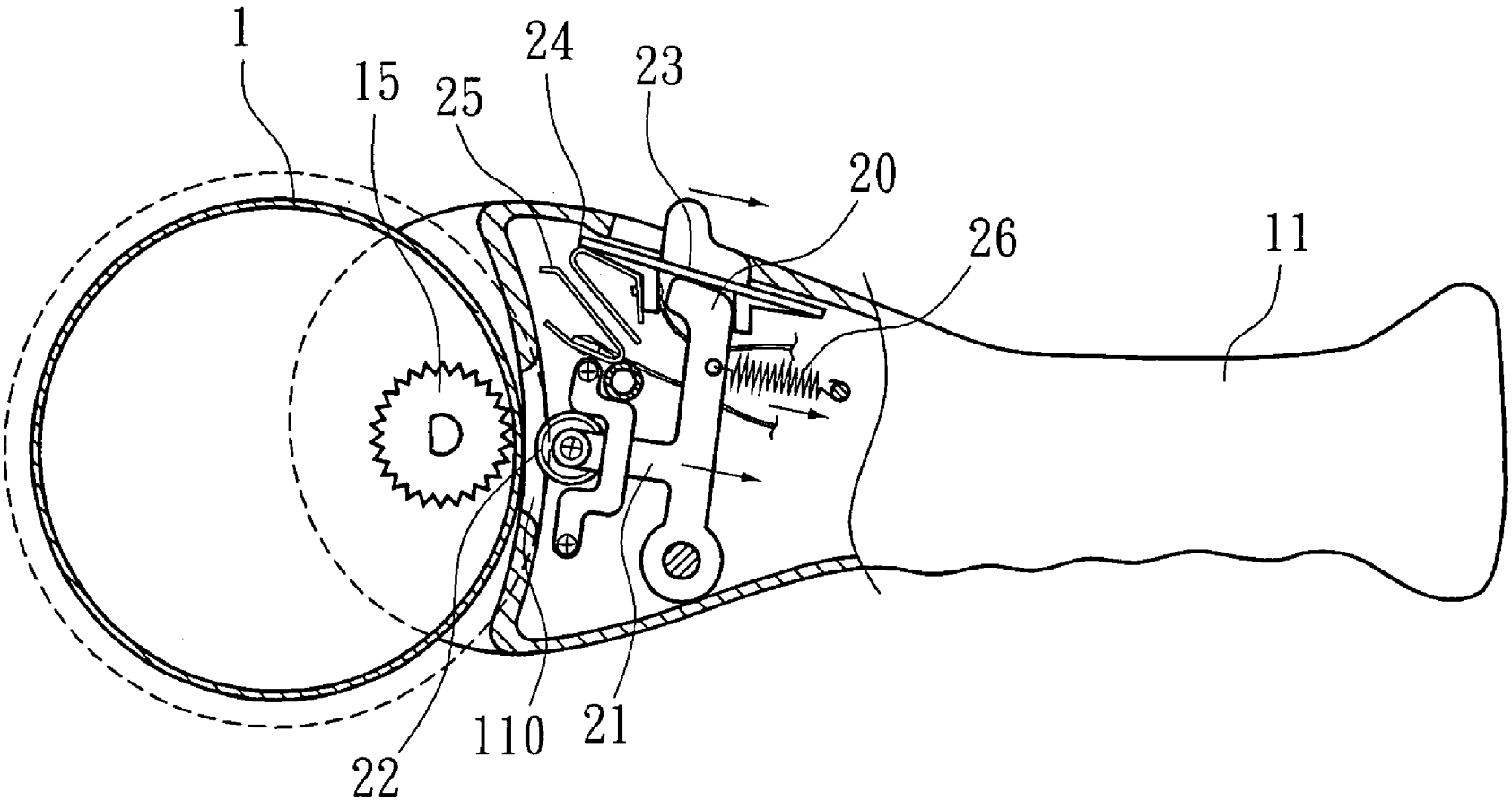
FIG. 3 is a sectional view of the battery-operated can opener, showing the switching lever in OFF position
Figure 4:
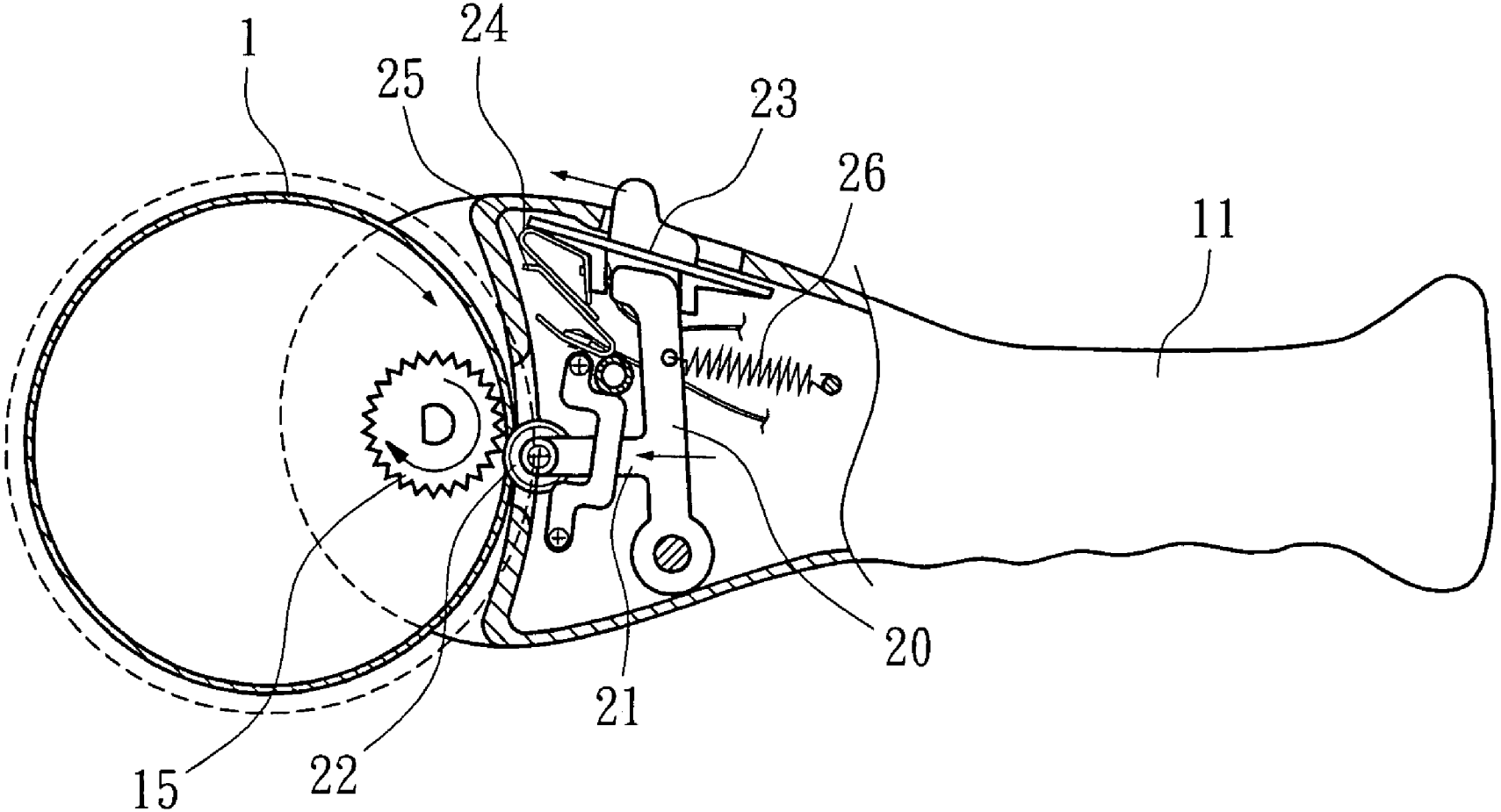
FIG. 4 is similar to FIG. 3 but showing the switching lever in ON position.

Referring to FIGS. 3 and 4, when in use, the battery-operated can opener is attached to the can 1, enabling the rim of the can 1 to be sandwiched in between the guide gear wheel 15 and the peripheral wall of the opening 110 of the bottom cover shell 11, and then pull the switching lever 23 to extend the cutter 22 out of the opening 110 against the lid of the can 1 and to simultaneously switch on the DC motor 12. When started the DC motor 12, the pinion 13 drives the transmission gear set 14 to rotate the guide gear wheel 15. At this time, the guide gear wheel 15 is moved along the rim of the can 1, and the cutter 22 is moved with the can opener to cut open the lid of the can 1. After opening of the can 1, release the hand from the switching lever 23. At this time, the return spring 26 immediately pulls the actuating arm 20 and the switching lever 23 backwards to their former position, and therefore the battery power supply is cut off from the DC motor 12.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A battery-operated can opener comprising a housing, said housing having an opening, a DC motor and a battery mounted inside said housing, said DC motor having a pinion fixedly mounted on an output shaft thereof, a transmission gear set mounted inside said housing and coupled to said pinion, a switching lever pivotally mounted in one side of said housing and partially extending out of said housing for operation by a user's hand, a first metal contact fixedly mounted inside said housing and electrically connected to a first pole of said battery and said DC motor, a second metal contact plate fixedly mounted on one end of said switching lever and electrically connected to a second pole of said battery and said DC motor and movable with said switching lever to contact said first metal contact and to further close a circuit of said battery and said DC motor, an actuating arm, said actuating arm having a first end pivotally fastened to said housing and a second end connected to said switching lever, an extension rod perpendicularly extending from said actuating arm, a cutter fixedly connected to said extension rod and movable with said extension rod in and out of the opening of said housing upon movement of said switching lever between an on position and an off position, and a guide gear wheel pivotally mounted outside of said housing near the opening and coupled to said transmission gear set for rotation by said transmission gear set to advance the can opener along a rim of a can to be cut by said cutter.

2. The battery-operated can opener as claimed in claim 1, further comprising a return spring connected between said housing and said actuating arm.

* * * * *